United States Patent [19]

Talmadge et al.

[11] 4,219,073

[45] Aug. 26, 1980

[54] HEAT SAVER DEVICE

[75] Inventors: Michael J. Talmadge, R.D. #1, Saratoga Springs, N.Y. 12866; Arthur C. Salvatore, Jr., 1255 Lowell Rd., Schenectady, N.Y. 12308; Anthony Garafalo, Clifton Park, N.Y.

[73] Assignees: Arthur C. Salvatore, Jr., Schenectady; Michael Talmadge, Saratoga Lake, both of N.Y.

[21] Appl. No.: 869,739

[22] Filed: Jan. 16, 1978

[51] Int. Cl.[2] ..... F28D 15/00

[52] U.S. Cl. ..... 165/39; 165/158; 165/175; 165/DIG. 2; 237/55

[58] Field of Search ..... 165/DIG. 2, 158, 39, 165/173, 175; 110/302; 122/DIG. 1; 237/55; 285/19, 202, 203, 222, 424

[56] References Cited

U.S. PATENT DOCUMENTS

| | | | |
|---|---|---|---|
| 2,343,542 | 3/1944 | Faunce | 237/55 |
| 2,468,909 | 5/1949 | Yeager et al. | 165/DIG. 2 |
| 2,568,278 | 9/1951 | Favot | 219/39 |
| 2,764,391 | 9/1956 | Pullen | 165/DIG. 2 |
| 2,882,023 | 4/1959 | Rizzo | 165/DIG. 2 |
| 3,124,197 | 3/1964 | Funk | 165/122 |
| 3,413,021 | 11/1968 | Potts | 285/424 |
| 3,533,466 | 10/1970 | Salamon | 165/39 |
| 3,727,663 | 4/1973 | McCabe | 285/424 |
| 3,761,116 | 9/1973 | Scheitlin et al. | 285/222 |
| 3,884,292 | 5/1975 | Pessolano et al. | 165/39 |
| 4,050,628 | 9/1977 | Konnerth | 237/55 |
| 4,078,602 | 3/1978 | Richer | 165/39 X |

FOREIGN PATENT DOCUMENTS

| | | | |
|---|---|---|---|
| 2536657 | 3/1976 | Fed. Rep. of Germany | 165/DIG. 2 |

*Primary Examiner*—Samuel Scott
*Assistant Examiner*—Margaret A. Focarino
*Attorney, Agent, or Firm*—Pollock, Vande Sande & Priddy

[57] ABSTRACT

The present invention provides a novel heat exchanger which is adaptable for attachment to an exhaust stack of either an oil or natural gas furnace and includes a heat exchange chamber with a plurality of separate, closely packed tubular conduits arranged to transport hot exhaust gases therethrough, a fan assembly which is attached to a side wall of the heat exchanger and is selectively actuable to force ambient air around the plurality of tubular conduits to heat the ambient air and thereby provide an additional heat source, and a thermostat extending into the ambient air passageway for monitoring the ambient air temperature and selectively actuating the fan assembly when the ambient air reaches a pre-set temperature.

9 Claims, 5 Drawing Figures

HEAT SAVER DEVICE

BACKGROUND OF THE INVENTION

The present invention is directed to a novel air-to-air type heat exchange device adaptable for attachment to an exhaust stack of either an oil or natural gas furnace assembly. Heat is extracted from the hot exhaust gases passing through the heat exchange device to provide an additional source of heating for residential as well as commercial buildings.

While it is known to attach a heat exchanger to an exhaust gas passageway, the known devices have proved both cumbersome and costly, while failing to efficiently transfer heat from the exhaust gases to the ambient air passageway.

As for example, in U.S. Pat. No. 3,533,466, issued Oct. 13, 1970, to Saloman et al., a heat exchanger is attached to the exhaust gas passage of a refuse incinerator to cool the exhaust gases emanating therefrom. A complex multi-fan assembly continuously directs a variable volume of cooling air past the exhaust gas passageway. A thermostat is positioned within an outlet of the exhaust gas passageway and selectively actuates one of the fans responsive to an increase in the temperature of the exhaust gas.

The multi-fan arrangement disclosed in Saloman et al. requires a separate motor and control mechanism for each fan which proves to be both cumbersome and costly. Applicant, in comparison, provides a unitary device requiring a single fan motor and associated control mechanism.

The thermostat in Saloman et al. is positioned within the outlet of the hot exhaust gases and is susceptible to accidental off-cycling due to the large temperature variations which may often occur within a furnace exhaust.

In response to this problem, applicant has designed a novel assembly wherein the thermostat is positioned within the ambient air passageway which is much less susceptible to large temperature variations. Furthermore, applicant's thermostat is less likely to prematurely fail because it does not come in direct contact with the hot exhaust gases.

While the U.S. Pat. No. 3,884,292 issued May 20, 1975, to Pessolano et al. does disclose a heat exchange device including a thermostat positioned in the ambient air passageway, the Pessolano et al. device can be distinguished as requiring a plurality of sealed intermediate heat transfer tubes which are neither described nor required by applicant's device.

As will be discussed in detail, the present invention provides a heat exchange device that overcomes the problems existing in prior art devices while including a plurality of novel design features for maximizing the heat transfer efficiency.

Summary of the Invention

An object of the present invention is to provide an efficient heat exchange device capable of reclaiming waste heat from the exhaust gases emanating from a residential or commercial furnace.

Another object is to provide a heat exchange device which is automatically actuated responsive to a predetermined temperature existing within the ambient air passageway surrounding the exhaust gas passageway.

A yet further object of the present invention is to provide a novel heat exchange device capable of attachment to either an oil or natural gas furnace.

The heat exchange device of the present invention comprises a generally box-like, hollow chamber formed of galvanized steel and including a pair of spaced parallel manifold plates. Each of the plates is formed with a corresponding arrangement of through apertures for supporting up to 72 seamless steel tubular conduits extending therebetween.

Input and output apertures are formed in opposite end walls of the chamber allowing the heated exhaust gases to enter the chamber via the input aperture, pass through the individual tubular conduits and exit the chamber via the output aperture. A separate pair of apertures are formed in opposite side walls of the chamber and a squirrel cage fan assembly is attached to the chamber forming an air passage from the fan through one of the side wall apertures, around the tubes and through the remaining side wall aperture. The fan is selectively actuated to force ambient air through the chamber and into a conduit which may extend to area to be heated. A thermostat, positioned in the ambient passageway, actuates the squirrel cage fan automatically when the ambient temperature exceeds a predetermined level.

The chamber end plates are formed with input and output apertures and support transition elements positioned to provide a continuous streamlined passageway for the exhaust gases passing through the heat exchanger, increasing the efficiency of the heat transfer process. The individual tubular conduits are deformed rather than welded into attachment with the spaced manifold plates to eliminate the possibility of a weld failing during operation of the heat exchanger.

BRIEF DESCRIPTION OF THE DRAWINGS

The present invention can be best understood with reference to the following drawings, wherein:

FIG. 4 shows a perspective view of a single tubular conduit; while

Description of the Preferred Embodiment

Figure 1:
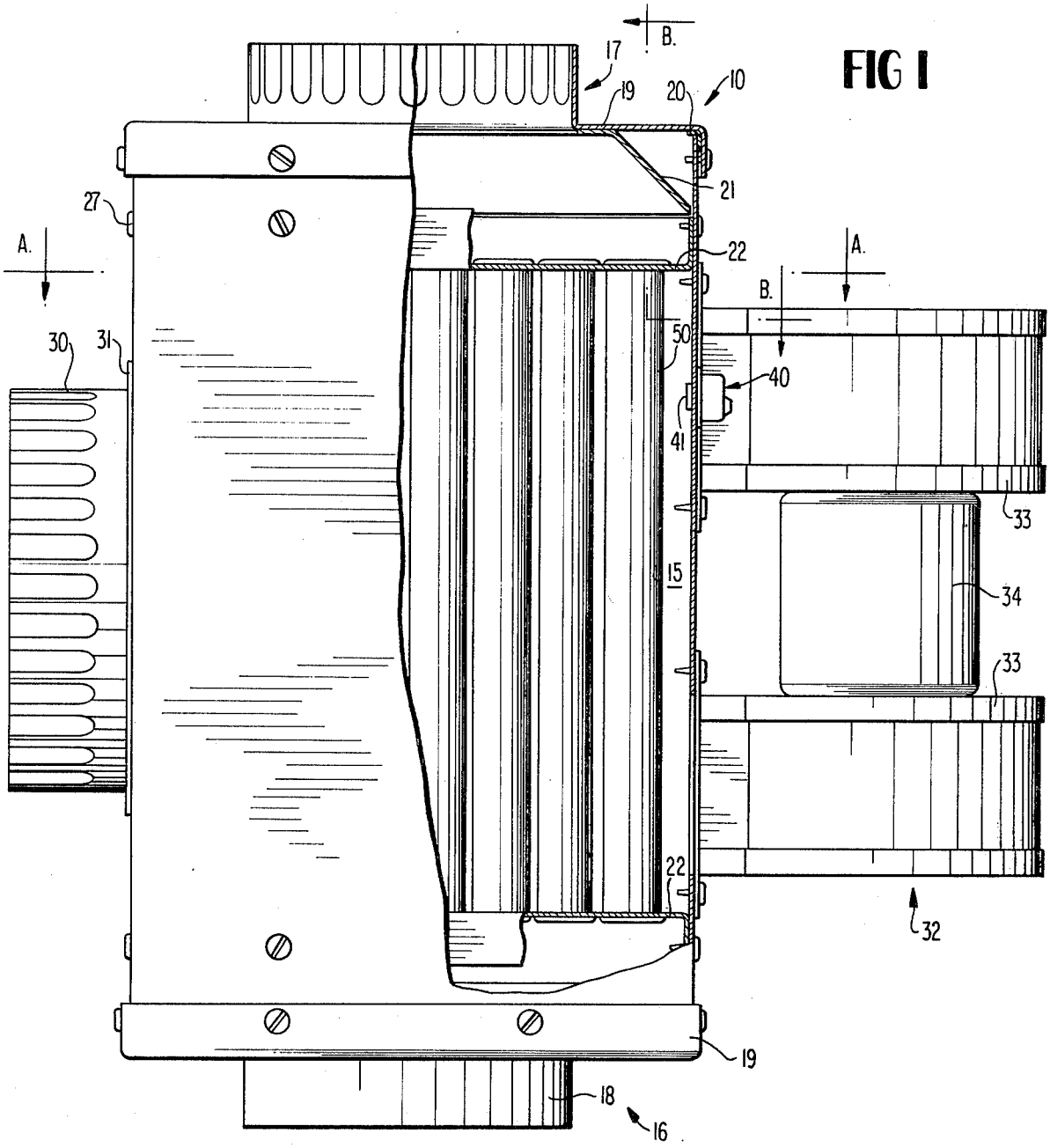
FIG. 1 shows a perspective view of a preferred embodiment of the present invention including a partially cut-away portion showing the position of the individual tubular conduits.

Referring to the drawings, and to FIG. 1 in particular, a heat exchange device 10 of a generally hollow, box-like configuration is shown. The heat exchange device 10 includes four identical and separate wall sections 11, 12, 13, and 14, best shown in FIG. 3, and which are joined to form a generally hollow chamber 15. Of course, it would be within the scope of the present invention to form the device 10 from a single piece of material which is deformed into a box-like configuration.

A pair of identical connecting elements 16 and 17 are adapted for connection with wall sections 11–14 and comprise several distinctive portions.

Figure 3:
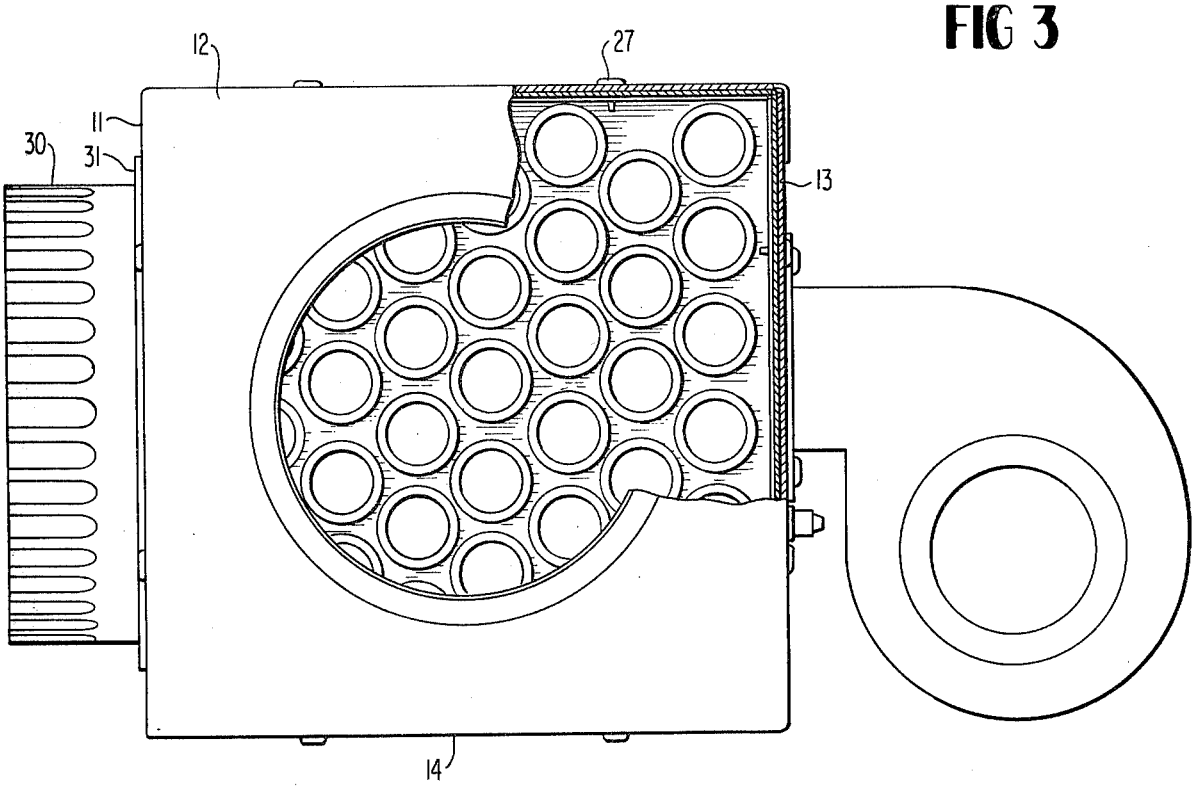
FIG. 3 shows a top view along the section A—A of FIG. 1 including a partially cut-away portion showing the relative position of the various individual tubular conduits.

Because connectors 16 and 17 are identical, only connector 16 will be described in detail. Connector 16 includes a cylindrically shaped hollow portion 18, which is adapted for connection to an exhaust stack of a natural gas furnace which is not shown. A pair of box shaped end plates 19 support the cylindrically shaped hollow portions 18 and include L-shaped end portions which overlap and are fastened to the wall sections 11–14 by a plurality of screws, as shown in FIG. 3. A sealer 20 may be placed between the flange portion of end plate 19 and the support wall 11–14.

The cylindrically shaped hollow portions 18 surround a pair of identical apertures formed through the end plates 19 of connectors 16 and 17, respectively, which allow hot exhaust gas to enter, pass through, and exit from heat exchanger 10.

Figure 2:
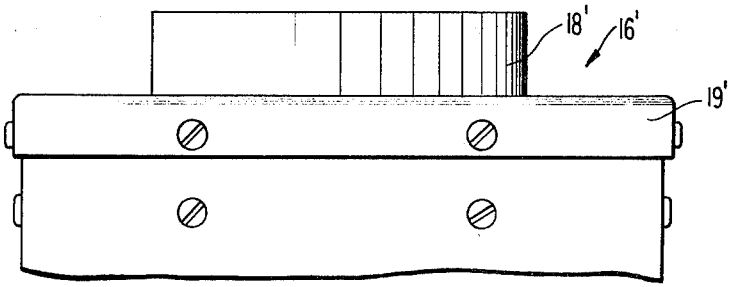
FIG. 2 shows a perspective view of a connector adaptable for use with an oil furnace exhaust stack.

Referring to FIG. 2, a connecting element 16' which is designed for attachment to an exhaust stack of an oil furnace is shown. The connecting element 16' includes distinctive portions 18', 19' corresponding to portions 18, 19 of the connecting element 16 shown in FIG. 1. A plurality of curved flow transition elements 21 are spot welded to an inside surface end plate 19 and an inside surface of wall sections 11–14 to provide a continuous streamlined passageway for the exhaust gases passing through device 10.

A pair of identically shaped parallel manifold plates 22 extend between separate wall sections 11–14, with each manifold plate 22 including a rectangular portion 23 adaptable for attachment with each of the separate wall sections 11–14.

Figure 5:
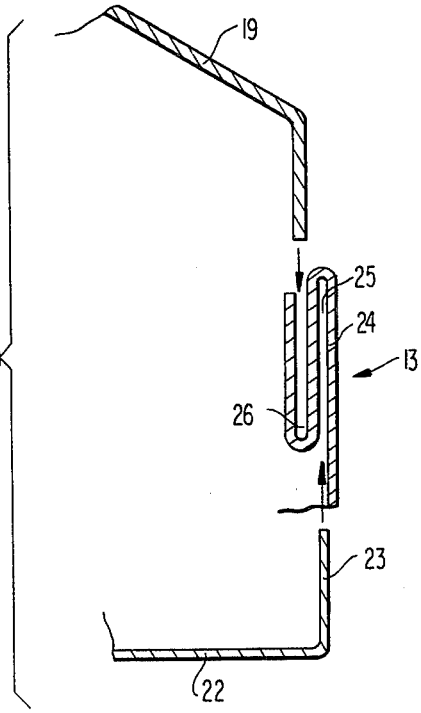
FIG. 5 shows a perspective view along a section B—B of FIG. 1 including a portion of the sloped covering plate.

Referring to FIG. 5, there is shown a second, preferred embodiment wherein one of a pair of identical S-shaped wall portions 24 formed on a first end portion of each of the walls 11–14. The wall portion 24 forms a pair of spaced channels 25 and 26 which are adaptable for supporting the rectangular flange portion 23 and a second end portion 11' of each of the wall sections 11–14, respectively. A plurality of conventional screws 27 are extended through each of the portions 11', 23 and 24 to releasably attach the connecting elements 16, 17 and the manifold plates 22 to each of the wall sections 11–14.

A cylindrically shaped, hollow connector 30 includes a boss portion 31 attached to wall section 11. Connector 30 is adapted for attachment to a tubular conduit, not shown, which transports the heat extracted from the exhaust gases to the enclosed area to be heated. A through aperture, also not shown, is formed in wall section 11 allowing the heated air to pass from chamber 15 into connector 30.

A squirrel cage fan assembly including a pair of air flow passages 33 and a drive motor 34 is attached to the side wall section 13 opposite hollow connector 30. A pair of apertures, not shown, are formed in wall section 13 corresponding in shape to air ducts 33. Actuation of squirrel cage fan motor 34 forces ambient air to pass through air passages 33, chamber 15, and hollow connector 30.

A thermostat 40 is attached to wall section 13 near the outlet of heat exchange device 10 and includes a probe 41 extending a small distance into hollow chamber 15. Thermostat 40 is electrically connected to drive motor 34 to automatically actuate squirrel cage fan assembly 32 in a manner to be hereafter described.

Figure 4:
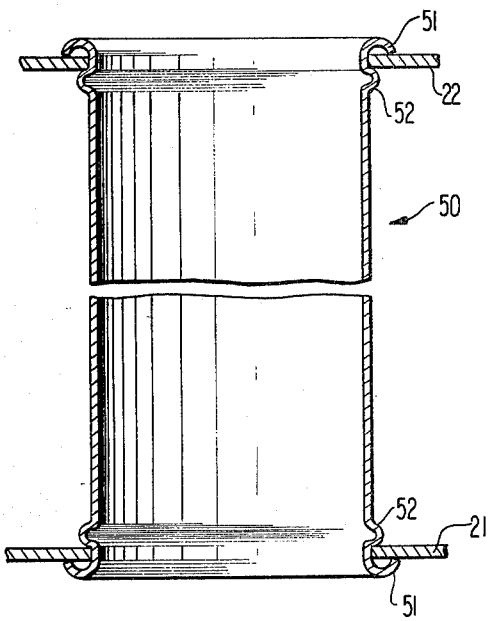

A plurality of identical, seamless steel tubular conduits 50 extend through a plurality of correspondingly positioned through apertures formed in manifolds 22. As more clearly shown in FIG. 4, each tubular conduit 50 includes a plurality of deformations 51 and 52 formed at both ends to provide a clamping attachment between the conduit 50 and the manifold plates 22. Because the conduits 50 are deformed rather than welded, the possibility of a weld failing due to the high temperature of the exhaust gases passing through conduit 50 is eliminated.

As can be clearly seen in FIG. 3, the individual tubular conduits 50 are positioned in close proximity to one another. This novel arrangement increases the time it takes ambient air to travel through the chamber 15, which maximizes the convective heat transfer between the exhaust gases and ambient air.

In the operation of the present invention, hot exhaust gases in a temperature range of 350° to 900° Fahrenheit pass from the furnace exhaust system, through heat exchanger 10 and eventually into the atmosphere. The exhaust gases enter heat exchanger 10 through input connector 16, pass through the plurality of tubular conduits 50 and exit the heat exchanger through output connector 17. Thermostat 40 is pre-set to sense a predetermined air temperature within chamber 15, as for example, 200° Fahrenheit. When the hot exhaust gases have heated the chamber 15, by means of convection, to a temperature greater than 200° Fahrenheit, thermostat 40 actuates squirrel cage fan assembly 32 to force ambient air through chamber 15 and hollow connector 30, and to an area to be heated.

Even though the furnace is shut off, the fan assembly 32 will continue to operate until the ambient air within chamber 15 drops to a temperature below 200° Fahrenheit, at which time thermostat 40 cuts off fan assembly 32.

It is envisioned that up to 72 separate tubular conduits 50 may be positioned within heat exchanger 10 when the device is attached to an oil furnace, while up to 48 tubular conduits may be used in conjunction with a natural gas furnace.

It is within the scope of the invention to form the heat exchanger 10 of a shape other than box-like. It would be further within the scope to use materials different than steel in forming the various heat exchanger components.

The invention is not limited to the above-described embodiment, but is limited only by the scope of the following claims.

I claim:

1. A heat exchange device for extracting waste heat from furnace exhaust gases and transferring the heat to a stream of ambient air providing a source of additional heat, and comprising:

a hollow casing enclosed at opposite ends by a pair of identically shaped end connectors, each of which includes an aperture formed therethrough;

said hollow casing further including a plurality of side walls with one side wall having a pair of spaced apertures extending therethrough, with said casing also including a further side wall having an aperture formed therethrough;

a pair of spaced manifold plates extending through said hollow casing and including a plurality of corresponding apertures formed through both said manifold plates;

each of said side walls further includes opposite end portions having a substantially S-shaped configuration, wherein a portion of one of said end connectors and a portion of one of said manifold plates are each inserted into a pair of separate channels formed in one of said S-shaped end portions, with a plurality of spaced attachment means releasably fastening both said and connector and said manifold plate to said respective S-shaped end portion;

a plurality of separate tubular conduits extending through said casing, with each conduit passing through a corresponding pair of apertures formed in said manifold plates;

said tubular conduits forming a plurality of separate, staggered rows each extending across said hollow casing, wherein each of the tubular conduits in one row intrudes between a pair of adjacent tubular conduits positioned in an adjacent row to increase the time it takes the ambient air stream to travel through said hollow casing;

a fan assembly positioned adjacent said casing including a tubular passageway surrounding at least one of said two apertures formed through said one side wall; and temperature sensing means attached to said casing for actuating said fan assembly only when the ambient air within said casing exceeds a predetermined temperature.

2. A heat exchanger according to claim 1, wherein said casing is formed from a single piece of material which is deformed into a generally box-like member.

3. A heat exchanger according to claim 1, wherein each of said pair of identical end connectors include: a cylindrically shaped hollow portion, an end portion abutting said hollow casing and including a through aperture alignable with said cylindrically shaped hollow portion, and a plurality of flow transition elements attached to said end plate and said casing providing a streamlined flow path for said hot exhaust gases passing through said device.

4. A heat exchanger according to claim 1, wherein each of said tubular conduits comprises a thin walled seamless steel member.

5. A heat exchange device according to claim 1, wherein each tubular conduit is deformed on both sides of each of said spaced manifold plates for fastening said tubular conduits within said heat exchange casing.

6. An apparatus according to claim 1, wherein said fan assembly includes:

a squirrel cage type fan and drive motor, which includes a pair of tubular air passageways attached to said one side wall of said casing and surrounding said pair of spaced apertures formed through said one side wall of said casing; and a control mechanism for actuating said fan assembly to force air through said air passageways and this spaced apertures into said hollow casing, around said tubular conduits and out of said casing via said aperture formed through said further side wall.

7. An apparatus according to claim 1, wherein said temperature responsive means includes a thermostat attached to said casing, and including a temperature probe extending into said casing for sensing the temperature of the air within said casing and an electrical control assembly for actuating said fan assembly only when said thermostat senses a predetermined ambient air temperature within said casing.

8. An apparatus according to claim 7, wherein said fan assembly is selectively actuated to force air through said casing and around the individual tubular conduits, with said ambient air extracting heat by convection from said hot exhaust gases passing through said individual tubular conduits, and said heated ambient air flowing from said casing to provide an additional source of heat.

9. An apparatus according to claim 1, wherein said heat exchange device is adaptable for connection to either an oil furnace exhaust or a natural gas furnace exhaust.

* * * * *